US009168577B2

(12) United States Patent
Caporusso

(10) Patent No.: US 9,168,577 B2
(45) Date of Patent: Oct. 27, 2015

(54) BENDING MACHINE FOR HELICALLY BENDING AN ELONGATED WORKPIECE

(71) Applicant: CML INTERNATIONAL S.p.A., Piedimonte San Germano (IT)

(72) Inventor: Alessandro Caporusso, Piedimonte San Germano (IT)

(73) Assignee: CML INTERNATIONAL S.P.A., Piedimonte S. Germano (IT)

( * ) Notice: Subject to any disclaimer, the term of this patent is extended or adjusted under 35 U.S.C. 154(b) by 262 days.

(21) Appl. No.: 13/658,865

(22) Filed: Oct. 24, 2012

(65) Prior Publication Data

US 2013/0098130 A1 Apr. 25, 2013

(30) Foreign Application Priority Data

Oct. 24, 2011 (IT) ..... RM2011A0557

(51) Int. Cl.
*B21D 11/06* (2006.01)
*B21D 5/14* (2006.01)

(52) U.S. Cl.
CPC . *B21D 11/06* (2013.01); *B21D 5/14* (2013.01)

(58) Field of Classification Search
CPC ..... B21D 11/06; B21D 7/08; B21D 7/02; B21D 7/022; B21D 7/024; B21D 7/04; B21D 5/14
USPC ..... 72/173, 237, 252.5, 247, 249, 170, 171, 72/172, 174, 175; 384/192; 403/59, 61, 403/53, 114
See application file for complete search history.

(56) References Cited

U.S. PATENT DOCUMENTS

| | | | | | |
|---|---|---|---|---|---|
| 1,847,677 | A | * | 3/1932 | Sternbergh | 464/145 |
| 1,926,830 | A | * | 9/1933 | Yates | 72/173 |
| 1,928,114 | A | * | 9/1933 | Scheffler | 384/558 |
| 3,523,438 | A | * | 8/1970 | Moore | 72/144 |
| 3,704,616 | A | * | 12/1972 | Taira | 72/167 |
| 4,645,369 | A | * | 2/1987 | Albert, Jr. | 403/24 |

(Continued)

FOREIGN PATENT DOCUMENTS

| | | |
|---|---|---|
| CN | 2476361 | 2/2002 |
| DE | 3912244 A1 | 10/1990 |
| EP | 0992297 A1 | 4/2000 |
| JP | 3086324 A | 4/1991 |

OTHER PUBLICATIONS

European Search Report, dated Nov. 29, 2012, from corresponding EP application.

*Primary Examiner* — Shelley Self
*Assistant Examiner* — Gregory Swiatocha
(74) *Attorney, Agent, or Firm* — Young & Thompson

(57) ABSTRACT

A bending machine for helically bending an elongated workpiece (T) has at least three bending rollers (2) that, being rotatable integrally with respective supporting shafts (3) with parallel axes (y), co-operate in bending the elongated workpiece (T). Each bending roller (2) is arranged to shift along its own supporting shaft (3) by way of a prismatic coupling for a limited stroke and to swing with respect to the axis of the supporting shaft (3) by way of a partially spherical body (8) forming a rotary coupling with the supporting shaft (3) in a limited amount of angular displacement according to an arc of meridian of the partially spherical body (8), so that each bending roller (2) is orientated coplanar to the elongated workpiece (T) that takes an inclined position on the basis of a desired helix pitch.

4 Claims, 4 Drawing Sheets

(56) References Cited

U.S. PATENT DOCUMENTS 4,723,431 A * 2/1988 McKindary ..... 72/173
4,850,212 A * 7/1989 Frey ..... 72/166
6,623,167 B2 * 9/2003 Bass et al. ..... 384/537
2004/0237619 A1 * 12/2004 Caporusso ..... 72/171

* cited by examiner

BENDING MACHINE FOR HELICALLY BENDING AN ELONGATED WORKPIECE

FIELD OF THE INVENTION

The present invention relates to a bending machine for helically bending an elongated workpiece.

BACKGROUND OF THE INVENTION

In the present bending machines that are disposed generally horizontally, at least three rollers are rotatable together with respective supporting shafts having vertically arranged parallel axis. The vertical axis rollers co-operate in bending an elongated workpiece, such as a section or a pipe.

In these kinds of machines, the vertical axis rollers are arranged horizontally coplanar so that a workpiece helix extends in height in a cylindrical shape thanks to a horizontal axis roller being idly mounted downstream of the vertical axis third roller. Since the horizontal axis roller is height adjustably mounted so to project with respect to the vertical axis rollers, a helix pitch is obtained.

The diverging action exerted by the horizontal axis roller counteracting the action accomplished by the vertical axis rollers that would tend to maintain the elongated workpiece on the same plane of symmetry, determines a state of stress which irregularly deforms the elongated workpiece besides to wear unevenly the vertical axis rollers due to their eccentric operation.

The Chinese patent CN 2476361 describes a helical bending machine with multiple heads. In the patent drawings, bending rollers in one piece with internal helical wheels, are shown coplanar inclined according to the helix pitch of a pipe being worked with respect to respective drive shafts that the helical wheels engage by their internal toothings. However, it is not clear from the drawings how this inclined arrangement of assemblies of helical wheels and bending rollers is achieved and maintained, nor said arrangement is explained in detail in the description of the patent. If this inclined arrangement is achieved by an inclination of the internal helical wheels with respect to the rollers that are external to them, this inclination should be able to be changed depending on the helix pitch of the workpiece, or the assemblies of helical wheels and bending rollers should be changed every time a helical bending operation is decided to be performed with a different pitch.

Furthermore, since the bending machine in the above mentioned Chinese patent is not of the kind in which the bending rollers are integral with the supporting shafts like in the bending machine of the present invention, but they are moved by shafts through respective toothings, the construction of the bending machine is particularly complex and susceptible to failure and breakdown.

SUMMARY OF THE INVENTION to In this context, the technical task underlying the present invention is to propose a bending machine for helically bending an elongated workpiece which overcomes the above mentioned construction drawbacks.

In particular, an object of the present invention is to provide a bending machine for helically bending an elongated workpiece, the bending machine being able to avoid stresses that irregularly deform the elongated workpiece, and to prevent an uneven wear of the rollers.

A further object of the invention is to enable an automatic variation of inclination of the bending rollers of a helical bending machine in which the bending rollers rotate integrally with their supporting shafts according to the desired helix pitch for an elongated workpiece.

The object is generally achieved by a bending machine for helically bending an elongated workpiece, comprising at least three bending rollers that co-operate in bending the elongated workpiece by rotating together with respective supporting shafts having parallel axes, wherein each bending roller is able to shift along its supporting shaft by means of a prismatic coupling in a limited linear stroke, and to swing by means of a rotary coupling in a limited amount of angular displacement according to an arc of meridian with respect to the axis of the supporting shaft so that each bending roller is orientated coplanar to the elongated workpiece that takes an inclined position depending on a desired helix pitch.

BRIEF DESCRIPTION OF THE DRAWINGS

In the following detailed description, an embodiment of the invention is explained as defined in the enclosed dependent claims and illustrated in the accompanying drawings in which:

DETAILED DESCRIPTION OF A PREFERRED EMBODIMENT

Figure 1:
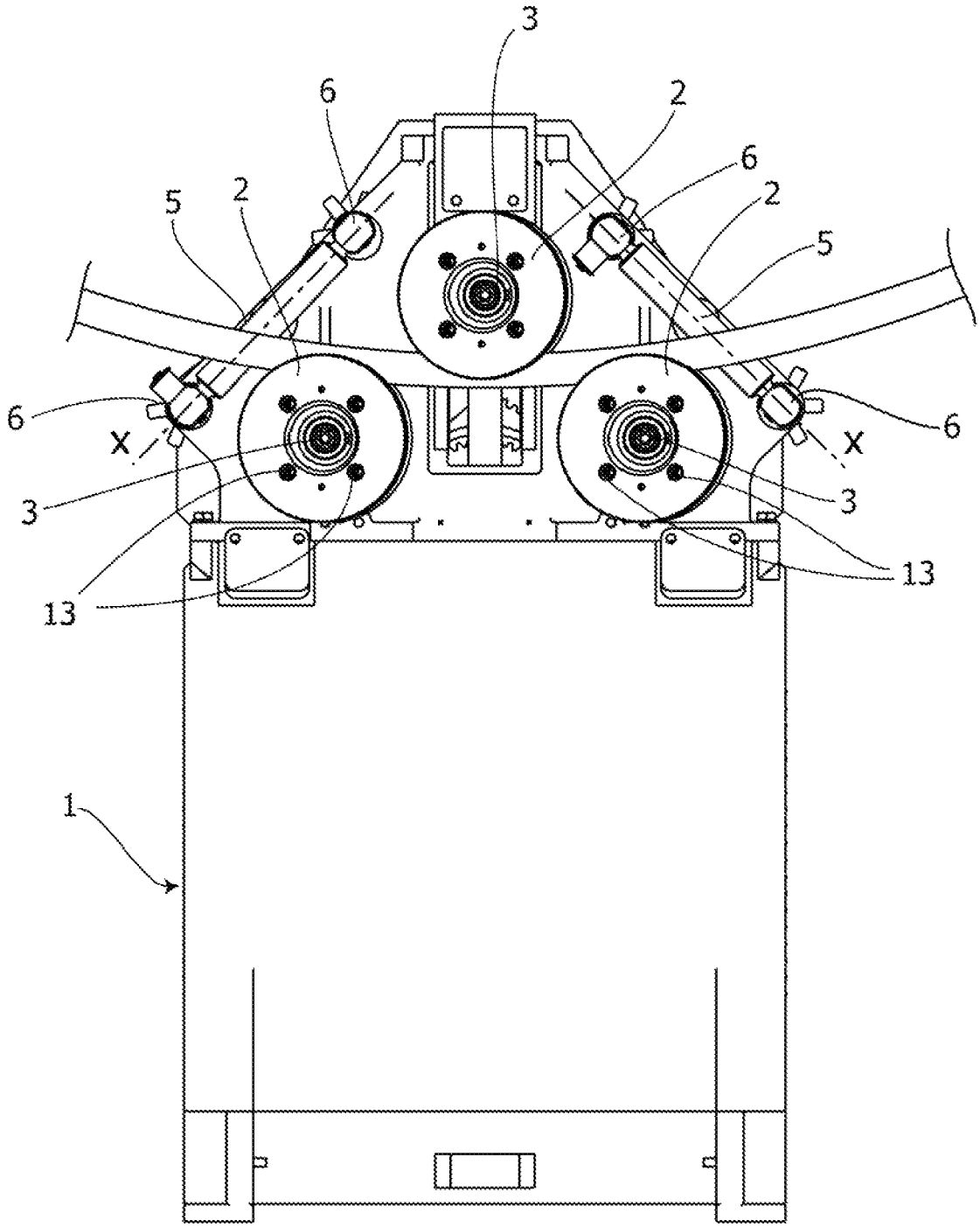
FIG. 1 is a diagrammatic top plan view of the bending machine according to the invention.
Figure 2:
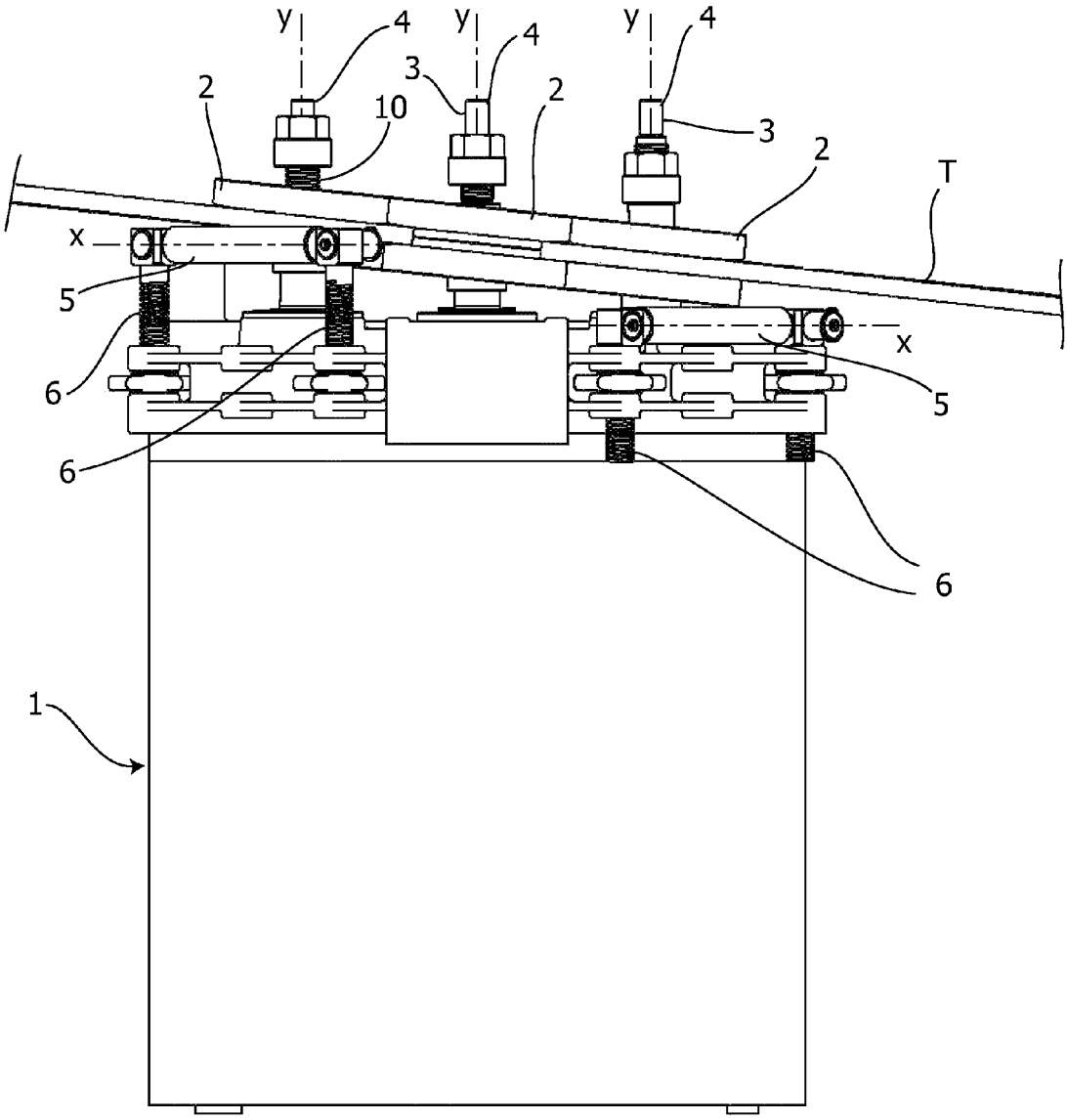
FIG. 2 is a diagrammatic side view of the bending machine in FIG. 1.

Referring initially to the plan view and the side view of FIGS. 1 and 2, there is shown a bending machine for helically bending an elongated workpiece T. A machine body is denoted as 1 where generically indicated as 2 are bending rollers, whose operation is not further described because it is conventional. The bending rollers 2, three in number, are mounted on respective supporting shafts having parallel axes y. The supporting shafts generally indicated as 3 are threaded near their free ends 4.

Conventionally, the three bending rollers 2, which rotate integrally with the respective supporting shafts 3, co-operate in bending the elongated workpiece T and are apt to be oriented coplanar to the elongated workpiece arranged in an inclined position by setting means for setting the helix pitch. In the present embodiment, the pitch setting means are constituted by idle rollers 5 having horizontal axis x, being mounted on end pins 6 that are height adjustable to determine the helix pitch.

According to the invention each bending roller 2 is arranged to shift along its shaft 3 for a stroke limited by means of a prismatic coupling and to swing by means of a rotary coupling for a limited amount of angular displacement along an arc of meridian from the axis y of the supporting shaft 3.

Figure 3:
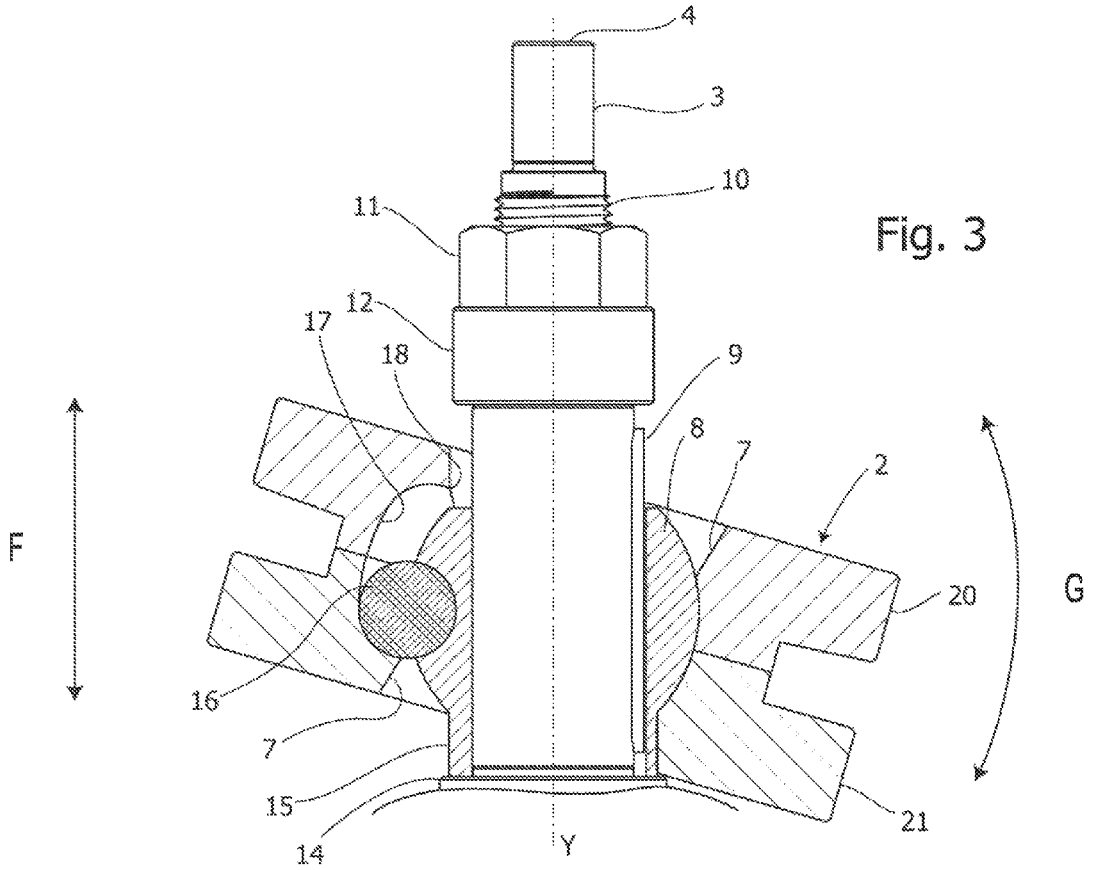
FIGS. 3 and 4 are enlarged cross-sections of a part of the bending machine in two opposite positions of a bending roller on its vertical axis shaft.
Figure 4:
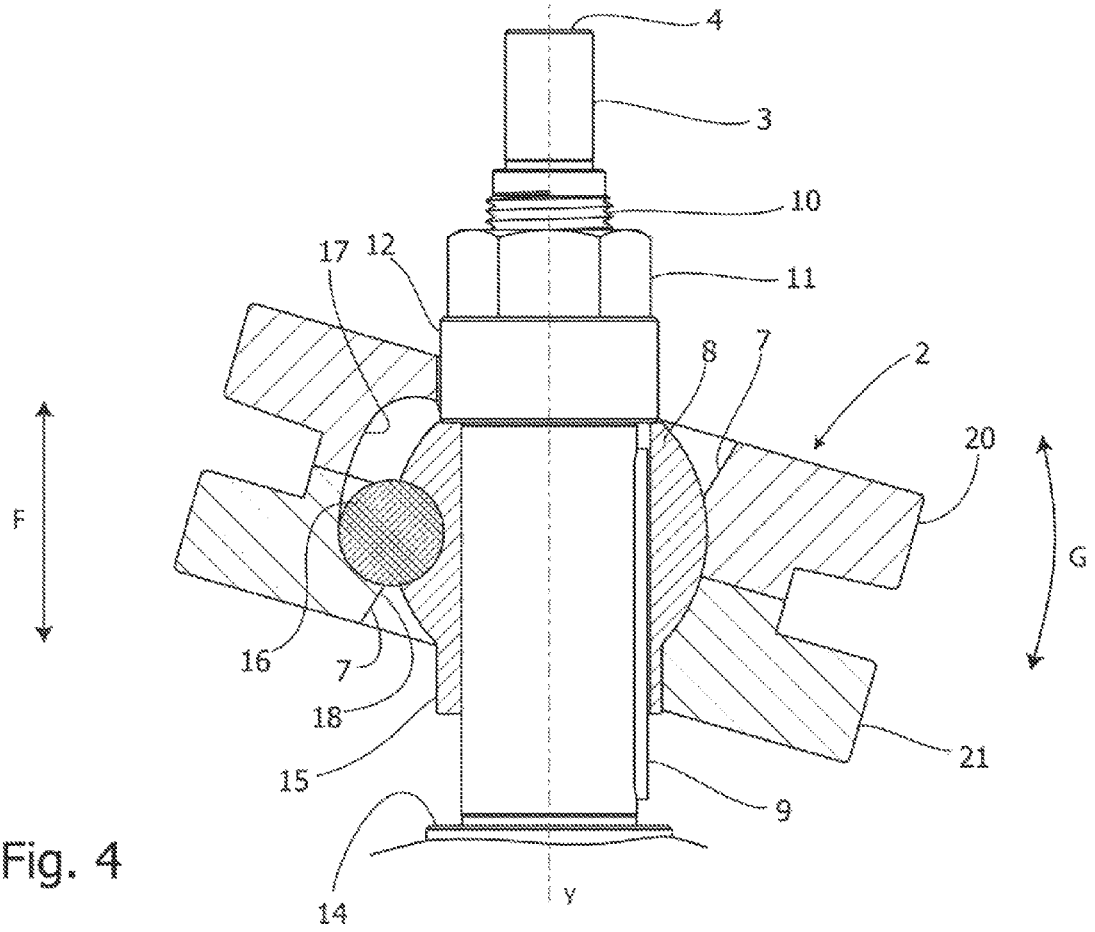

In order to observe in greater detail the degrees of freedom of the bending rollers and the limitations of their possible movement, reference is made now to FIGS. 3 and 4 which are enlarged sections of a part of the bending machine in two opposite positions of a bending roller 2 on its supporting shaft 3 having a vertical axis y.

Each bending roller 2 is made into two specularly symmetrical half-rollers 20, 21. Each half-roller 20, 21 is provided with a central recess 7 in a manner that each half-roller engages a partially spherical body 8, that is substantially a barrel having a central hole (not denoted by a reference numeral) along which the partially spherical body 8 is connected to its own supporting shaft 3 by means of a prismatic coupling. The prismatic coupling between partially spherical body 8 and the supporting shaft 3 is formed by a feather key 9. The supporting shaft 3 has a threaded portion 10 on which a nut 11 is screwed against a spacer 12 that limits the stroke of linear shift of the partially spherical body 8 and then the bending roller 2 formed of two half-rollers to 20, 21 engaged with it by fixing screws 13, as shown in FIG. 1. The direction of shift is indicated by the two-points arrow F.

Thanks to the prismatic coupling described above, the bending roller 2 can shift on the supporting shaft 3 between an abutment element 14, see the lower end position in FIG. 3, and the spacer 12, see the upper stroke end as shown in FIG. 4. The lower end position is obtained with a cylindrical extension 15 of the spherical body 8 in contact with an abutment element 14, while the position of upper stroke end is obtained with a top portion of the substantially spherical body 8 in contact with the spacer 12.

The partially spherical body 8 has a pocket (not indicated with a reference numeral) for housing a ball 16. The pocket has dimensions such as to protrude the ball 16 in an inner race 17 that is semi-closed at its ends 18, 18 to prevent the exit of the ball 16. The inner race 17 is made in the central recess 7 of each half-roller 20, 21 to create a linear spherical coupling between the partially spherical body 8 and the roller 2 obtained by the union of the half-rollers 20, 21 joined by screws 13. The ball 16 in the inner race 17 limits the amount of angular displacement along an arc of meridian of the roller 2 with respect to the partially spherical body 8. The arc of meridian is schematised in a curved two-points arrow G.

The vertical movement of the rollers in the lower and upper positions can take place continuously in order to allow the three bending rollers 2 to be conformed to the pattern of the helix according to which the elongated workpiece T is deformed. The shift of each bending roller 2 is permitted by the partially spherical body 8 which is contained within its cavity 7 and slides on the supporting shaft 3. The locking nut 11 prevents the bending rollers 2 to escape from the supporting shaft 3.

Thanks to the arrangement according to the present invention, the bending rollers 2 can be oriented coplanar along the respective supporting shafts 3, to which the bending rollers 2 are rigidly connected. The idle rollers 5 arranged at different heights, as shown in FIG. 2, determine the helix pitch to be obtained; the bending rollers 2 are arranged according to the inclination that determines that helix pitch, as they are able to shift along the respective supporting shafts 3 and turn in a linear fashion along a meridian. The stroke is limited by the spacer 12 and the abutment element 14, while the rotation is determined by the ball 16 engaging the race 17. In this way, the bending rollers 2 may perform the curvature of the elongated workpiece T by co-operating with the idle rollers 5 to get the desired helix pitch. Thanks to the invention, such a co-operation takes place with an orientation of the bending rollers 2 according to the inclination determined by the idle rollers 5 without an unnecessary stress state on the elongated piece T, or a wear on the rollers.

What is claimed is:

1. A bending machine for helically bending an elongated workpiece, comprising:

at least three bending rollers that cooperate in bending the elongated workpiece by rotating together with respective supporting shafts having parallel longitudinal axes, each bending roller being configured to shift along its supporting shaft by a prismatic coupling in a limited linear stroke and to swing with respect to the longitudinal axis of the supporting shaft of the respective bending roller by a partially spherical body forming a rotary coupling with the supporting shaft of the respective bending roller in an amount of angular displacement according to an arc of meridian of the partially spherical body so that each bending roller is oriented coplanar to the elongated workpiece that has an inclined position with respect to a longitudinal axis of the bending machine depending on a desired helix pitch, wherein each bending roller is made from two half-rollers that are provided with a central space so that each half-roller engages the partially spherical body having a central hole along which the partially spherical body is connected to the supporting shaft of the respective bending roller by the prismatic coupling, and wherein said partially spherical body has a pocket configured to house a ball projecting into an inner race defined in the central space of each of the bending half-rollers, the inner race being half closed at ends thereof to prevent the ball from slipping out from the central space, the inner race creating a spherical coupling between said partially spherical body and said bending roller by said ball to limit the amount of angular displacement according to said arc of meridian.

2. The bending machine according to claim 1, wherein a feather key is disposed between the partially spherical body and the supporting shaft of each bending roller to achieve the prismatic coupling between the partially spherical body and the supporting shaft, and the supporting shaft has a threaded portion on which a nut is configured to be screwed against a spacer limiting a shift stroke of the partially spherical body and the bending roller.

3. The bending machine according to claim 1, wherein the partially spherical body has an abutting cylindrical extension.

4. The bending machine according to claim 1, wherein the two bending half-rollers are a mirror image of each other.

* * * * *